US006773237B2

(12) United States Patent
Burford et al.

(10) Patent No.: US 6,773,237 B2
(45) Date of Patent: Aug. 10, 2004

(54) AIR COMPRESSOR WORKBENCH

(75) Inventors: Timothy W. Burford, New Ulm, MN (US); Andrew Kopel, LaFayette, MN (US)

(73) Assignee: Coleman Powermate, Inc., Kearney, NE (US)

( * ) Notice: Subject to any disclaimer, the term of this patent is extended or adjusted under 35 U.S.C. 154(b) by 68 days.

(21) Appl. No.: 09/939,943

(22) Filed: Aug. 27, 2001

(65) Prior Publication Data

US 2003/0039557 A1 Feb. 27, 2003

(51) Int. Cl.[7] ..... F04B 53/00
(52) U.S. Cl. ..... 417/234; 417/279; 307/116
(58) Field of Search ..... 417/306, 234, 417/236, 313, 312, 63, 279, 280, 212; 280/652; 137/565.18, 177, 195, 204, 565.4, 899.4; 415/180; 307/116, 118; 271/130; 434/219

(56) References Cited

U.S. PATENT DOCUMENTS

| | | | | | |
|---|---|---|---|---|---|
| 2,804,259 | A | * | 8/1957 | Ralston | 137/899.4 |
| 3,503,257 | A | * | 3/1970 | McElhaney et al. | 73/862.041 |
| 3,553,840 | A | * | 1/1971 | Bordelon | 433/77 |
| 3,582,233 | A | * | 6/1971 | Bloom | 417/12 |
| 3,602,610 | A | * | 8/1971 | Bloom | 417/12 |
| 3,845,702 | A | * | 11/1974 | Mies | 99/408 |
| 3,885,892 | A | * | 5/1975 | Dwyer et al. | 417/234 |
| 4,077,747 | A | * | 3/1978 | Burenga | 417/234 |
| 4,255,091 | A | * | 3/1981 | Dike, Jr. | 417/63 |
| 4,397,462 | A | * | 8/1983 | Wilmarth | 271/130 |
| 4,427,042 | A | * | 1/1984 | Mitchell et al. | 144/1.1 |
| 4,453,893 | A | * | 6/1984 | Hutmaker | 417/279 |
| 4,650,425 | A | * | 3/1987 | McGarry | 434/219 |
| 4,655,693 | A | * | 4/1987 | Grime | 417/212 |
| 4,729,722 | A | * | 3/1988 | Toth | 417/312 |
| 4,780,056 | A | * | 10/1988 | Toth | 415/180 |
| 4,830,056 | A | * | 5/1989 | Chamberlain | 137/899.4 |
| 4,870,811 | A | * | 10/1989 | Steele | 56/10.5 |
| 5,144,974 | A | * | 9/1992 | Gaudin | 137/204 |
| 5,147,182 | A | * | 9/1992 | Timmons | 417/234 |
| 5,222,871 | A | * | 6/1993 | Meyer et al. | 417/313 |
| 5,398,716 | A | * | 3/1995 | Hsu | 137/195 |
| 5,417,237 | A | * | 5/1995 | Stumphauzer et al. | 137/195 |
| 5,642,898 | A | * | 7/1997 | Wise | 280/652 |
| 6,065,942 | A | * | 5/2000 | Glidden et al. | 417/236 |
| 6,082,408 | A | * | 7/2000 | Werling et al. | 137/899.4 |
| 2002/0131872 | A1 | * | 9/2002 | Lucchi | 417/234 |

FOREIGN PATENT DOCUMENTS

| | | | | |
|---|---|---|---|---|
| JP | 362141426 | * | 6/1987 | F24C/1/00 |
| JP | 411336667 | * | 12/1999 | F04B/39/14 |
| JP | 2000107620 | * | 8/2000 | B02C/18/06 |

* cited by examiner

*Primary Examiner*—Denise Pothier
*Assistant Examiner*—Leonid M Fastovsky
(74) *Attorney, Agent, or Firm*—Leydig, Voit & Mayer, Ltd.

(57) ABSTRACT

A workbench for an air compressor that includes a work surface as its top surface. The workbench is provided on wheels, such as caster wheels. The workbench may be closed by panels to attenuate sound. The panels may be removable to provide access to the compressor for maintenance or repair. A mechanism may be provided whereby a drain for the air compressor may be remotely actuated so that the compressor tank may be drained without opening the panels or having to reach under the workbench. The power feed to the motor may be used to power an outlet on the workbench when the motor is not running. The outlet may be provided on the outer shell of the workbench (e.g., on a panel on the outside of the workbench). A switch may be provided that routes the power to the outlet instead of the motor.

17 Claims, 6 Drawing Sheets

FIG. 4
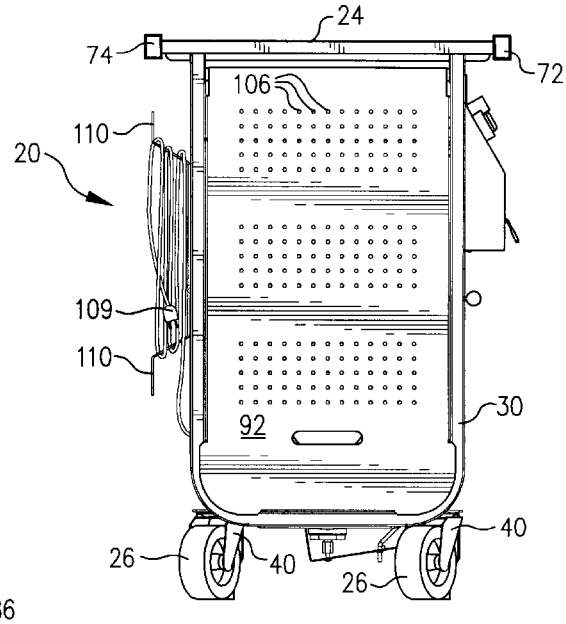
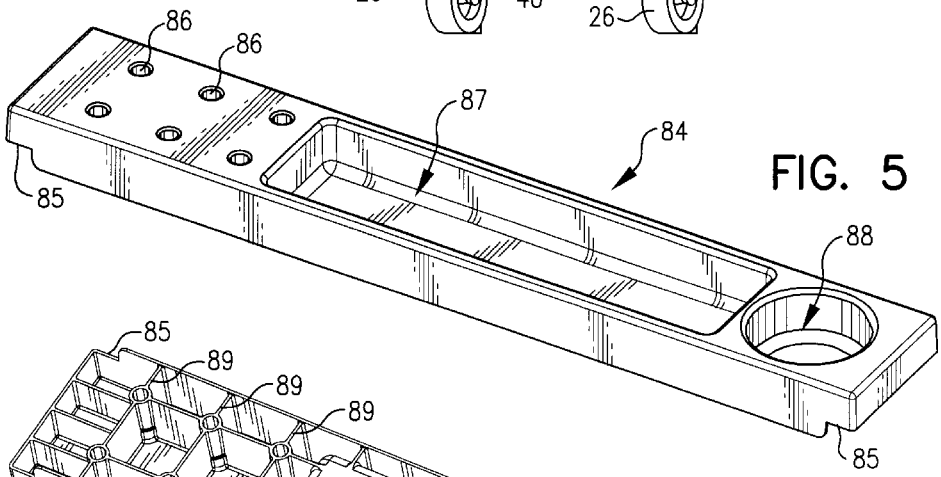
FIG. 5
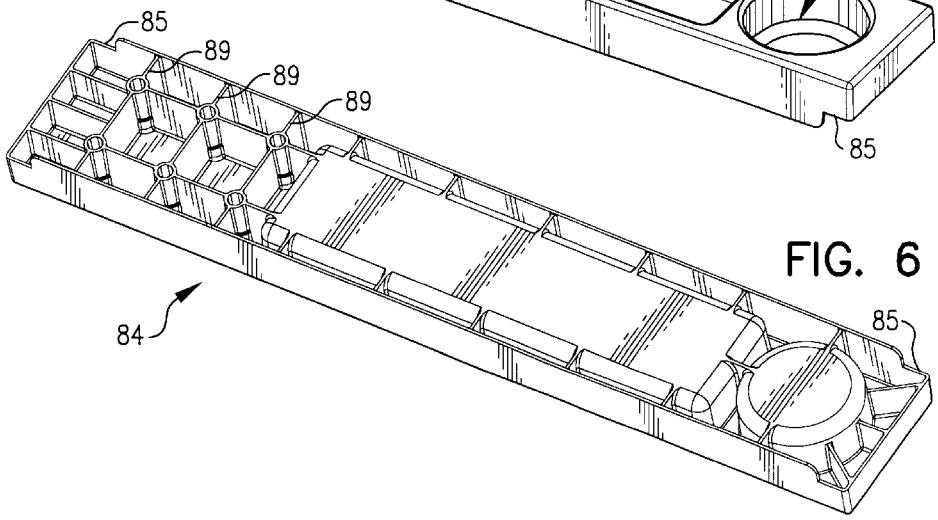
FIG. 6

AIR COMPRESSOR WORKBENCH

FIELD OF THE INVENTION

The present invention relates generally to power tools, and more particularly to compressors.

BACKGROUND OF THE INVENTION

Air compressors are becoming commonplace in home workshops. In general, an air compressor, or an air pump, is a machine that decreases the volume and increases the pressure of a quantity of air by mechanical means. Air thus compressed possesses great potential energy, because when the external pressure is removed, the air expands rapidly. The controlled expansive force of compressed air is used in many ways and provides the motive force for air motors and tools, including pneumatic hammers, air drills, sandblasting machines, and paint sprayers.

A conventional home workshop air compressor includes a storage tank for compressed air, and a prime mover mounted on the storage tank for compressing the air in the tank. The prime mover may be a gas engine or an electric motor, but most conventional home workshop models utilize electric power. The tanks are typically steel and cylindrical in shape, and sizes vary greatly, but typically, home workshop models range between four and thirty gallons. The air compressors typically include a pedestal of some kind (e.g., four feet) that allow the compressors to rest on a surface such as a floor. Alternatively, for some larger models, a pair of wheels may be provided on one end of the tank and a handle on the other end, permitting the air compressor to be wheeled around a work shop, for example.

While conventional air compressors work well for their intended purpose, they often add additional clutter in an already crowded work shop or garage. This problem is particularly true for compressors that have larger tanks, which handymen often select because of their larger air reserve capacity.

The size and configuration of conventional home workshop air compressors can also make their storage difficult. For most designs, the tanks are rounded, and the handle, pump, and the motor protrude above the tank. This configuration makes stacking or storing items on the tank difficult or impossible.

Another problem with air compressors is aesthetics. For most conventional air compressor designs, the motor, the tank, the wheels, and the handle are exposed, causing the compressor to have an industrial appearance. Although the compressor is often stored and used in a workshop environment, the various components that are visible on a compressor may make the workshop appear crowded or unkempt.

Home workshop air compressors can also be loud, especially in a closed environment. The compressor must run to generate and maintain pressure in the tank, and its operation can be a loud distraction.

SUMMARY OF THE INVENTION

The present invention solves many problems of the prior art by providing an air compressor that is mounted in a workbench. The workbench includes a work surface at its top, on which work may be performed, or items may be stored.

In accordance with one aspect of the invention, the workbench may be provided on wheels, such as caster wheels. This feature permits the compressor and workbench to be wheeled to a convenient location. The workbench may have open sides, so that the compressor is exposed, or may have panels so that the compressor is hidden from view. If panels are used, the workbench may have an attractive appearance, and thereby may easily be integrated into a workshop or other environment. In addition, the panels may be used to attenuate noise from the compressor motor. The panels may be removable to provide access to the compressor for maintenance or repair.

If panels are used on the outside of the workbench, in accordance with another aspect of the invention, a mechanism may be provided whereby a drain for the air compressor may be remotely actuated. For example, a handle may be provided on the outside of a panel on the workbench that is connected to the drain plug by a linkage. As another example, a foot pedal may be provided that is connected to the drain plug. The remote actuation of the compressor provides a mechanism by which the compressor tank may be drained without opening the panels or having to reach under the workbench.

The air compressor mounted within the workbench may utilize direct drive, belt drive, or other suitable drive systems. The prime mover for the air compressor is preferably electric. If the motor utilizes an electrical system, the power feed to the motor may be used to power an outlet on the workbench. The outlet may be provided on the outer shell of the workbench (e.g., on a panel on the outside of the workbench). A switch may be provided that routes the power to the outlet instead of the motor, or the outlet may be alive at all times.

Other advantages will become apparent from the following detailed description when taken in conjunction with the drawings, in which:

BRIEF DESCRIPTION OF THE DRAWINGS

FIG. 4 is a left side view of the compressor workbench of FIG. 1;

FIG. 5 is a top, side perspective view of a tool tray for the compressor workbench of FIG. 1;

FIG. 6 is a bottom, side perspective view of the tool tray of FIG. 5;

DETAILED DESCRIPTION

In the following description, various aspects of the present invention will be described. For purposes of explanation, specific configurations and details are set forth in order to provide a thorough understanding of the present invention. However, it will also be apparent to one skilled in the art that the present invention may be practiced without the specific details. Furthermore, well-known features may be omitted or simplified in order not to obscure the present invention.

Figure 1:
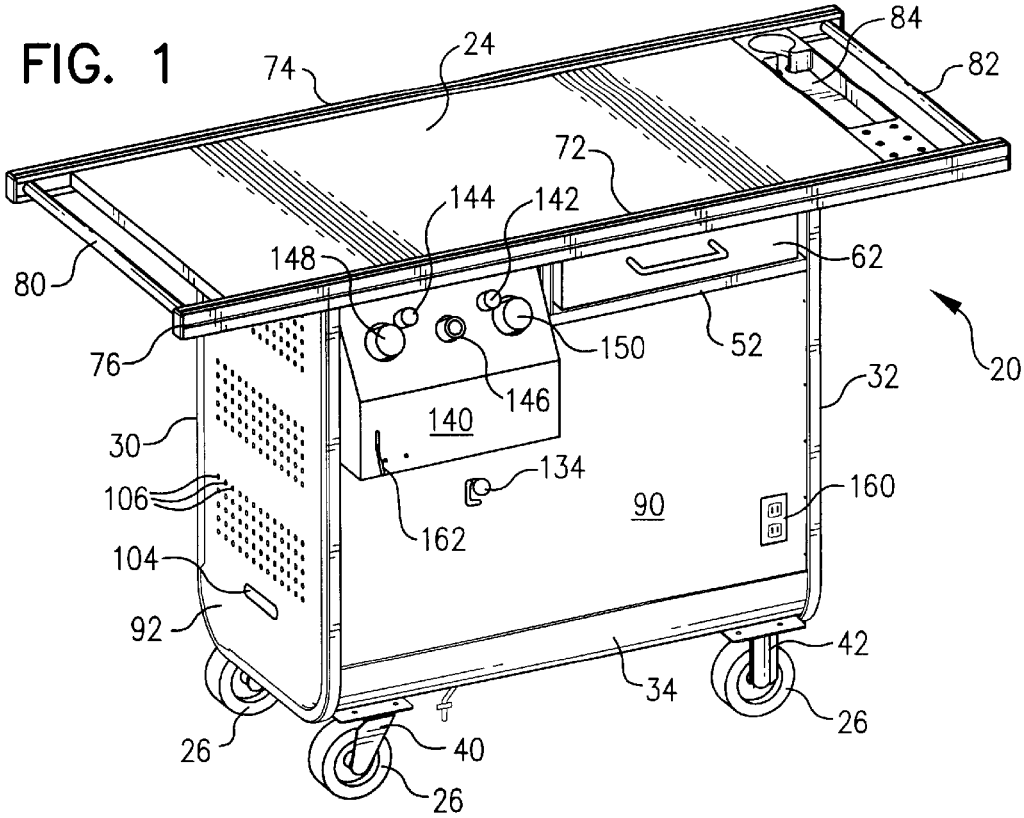
FIG. 1 is an isometric view of a compressor workbench in accordance with one aspect of the present invention.
Figure 2:
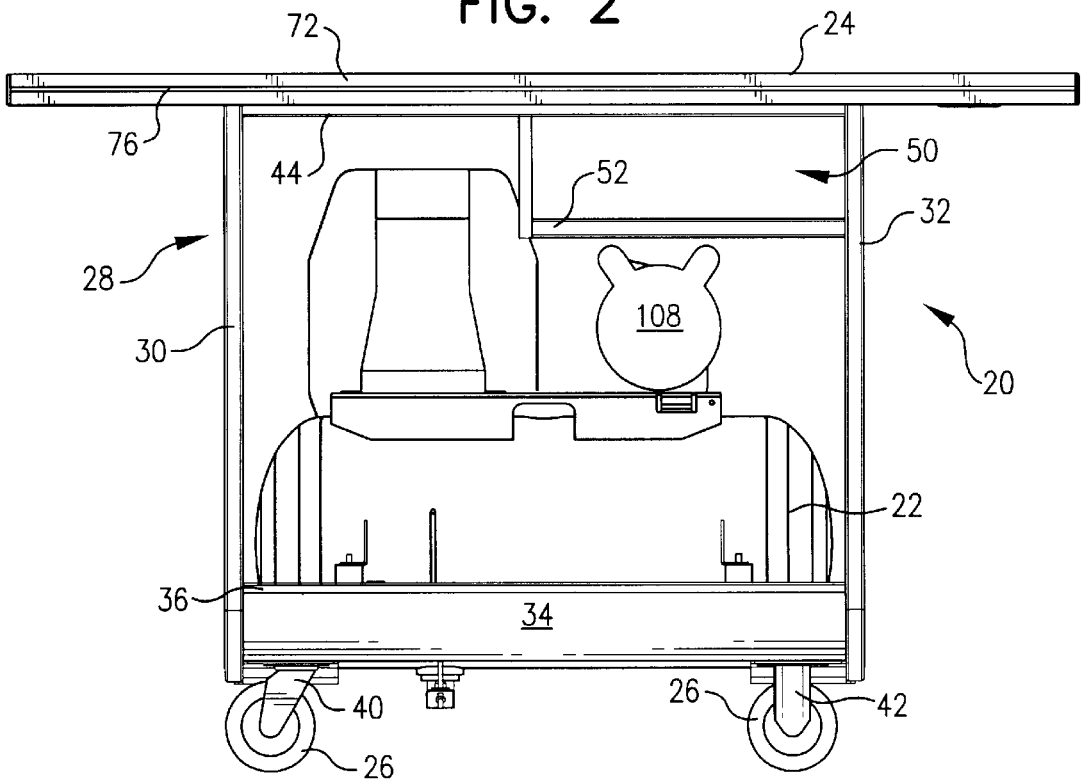
FIG. 2 is a front, view of a the compressor workbench of FIG. 1, with panels removed, exposing a compressor mounted in the workbench.

Briefly described, with reference to FIG. 1, the present invention provides a workbench 20 for an air compressor 22 (the air compressor is hidden in FIG. 1, but shown in FIG. 2). A work surface 24 is mounted on the top of the workbench 20, and the workbench includes wheels 26 so that the workbench may be easily moved.

Figure 3:
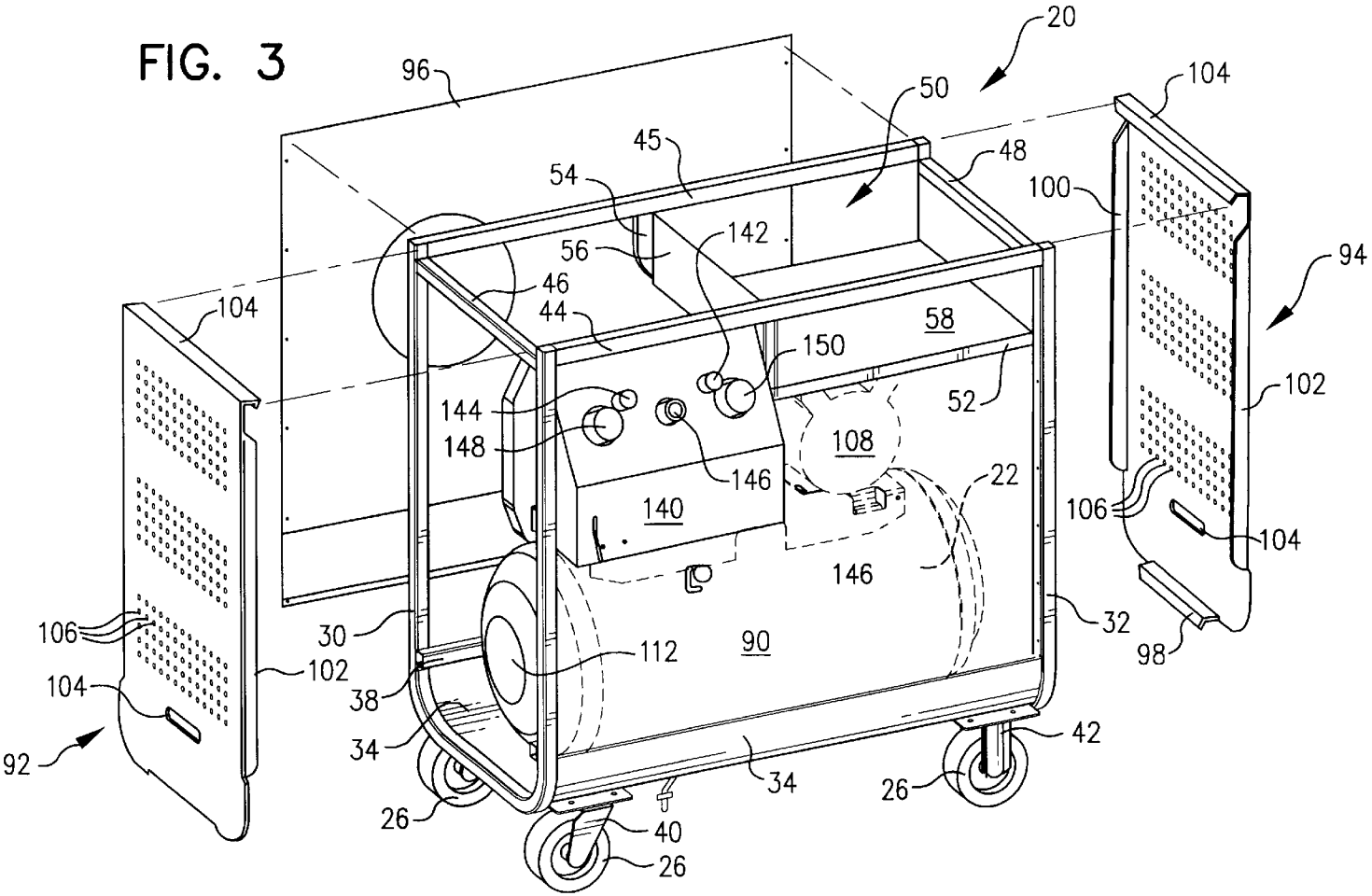
FIG. 3 is an isometric view of the compressor workbench of FIG. 1, showing side and rear panels and a work surface removed.

As can be seen in FIG. 2, the workbench includes a frame 28 made, for example, of tubular steel or aluminum. The frame 28 includes left and right U-shaped frame ends 30, 32 (detail of the left U-shaped frame end 30 is shown in FIG. 3), the top edges of which extend to the work surface 24. The lower parts of the left and right U-shaped frame ends 30, 32 are attached to a wheel support 34. The wheel support 34 may simply be a plate or a bracket that extends between the lower parts of the left and right U-shaped frame ends 30, 32, or may be a pan that extends around the bottom of the compressor 22.

Front and rear bottom frame members 36, 38 (FIGS. 2 and 3, respectively) extend along, and are attached, for example, by welding or screws, to the left and right U-shaped frame ends 30, 32. The front and rear bottom frame members 36, 38 provide structural reinforcement for the bottom of the frame 28.

The wheels 26 may be plastic, solid or inflatable rubber, or any other suitable material, and are attached to the bottom pan 34 by brackets 40, 42. As can be seen in FIG. 4, the brackets 40 on one end may swivel, and the brackets 42 on the other end may be fixed, so that the workbench 20 may be easily directed to a desired location. If desired, however, all four brackets 40, 42 may swivel for increased maneuverability of the workbench 20. In addition, if desired, one or more of the wheels may be lockable so as to secure the workbench 20 in position. Other suitable caster wheels may be used for the workbench 20, and may be attached as appropriate.

Front and rear top frame members 44, 45 (FIG. 3) extend between the top ends of the left and right U-shaped frame ends 30, 32. The front and rear top frame members 44, 45 extend against the work surface 24 and add further structural reinforcement to the frame 28. Side braces 46, 48 extend between upper ends of the left and right U-shaped frame ends 30, 32, and add further support for the frame 28.

The frame 28 includes a drawer housing 50. The drawer housing 50 includes front and rear L-shaped supports 52, 54, a side panel 56, and a bottom panel 58. The front and rear L-shaped supports 52, 54, along with the front and rear top frame members 44, 45 and the left and right U-shaped frame ends 30, 32, form a reinforced box for the front and rear ends of the drawer housing 50. As can be understood, the drawer housing 50 may be constructed differently. For example, a single piece of metal may be bent around the bottom and two sides, and/or the top of the housing. However, however constructed, preferably the panels of the drawer housing 50 (e.g., the side panel 56 and the bottom panel 58) separate the inside of the drawer housing 50 from the compressor, providing safety and cleanliness. A drawer 62 (FIG. 1) is mounted in the drawer housing 50, for example on drawer slides (not shown).

The work surface 24 is large, sturdy, and rectangular, and is made, for example, of MDF, wood, metal, or another suitable material. A pair of bars 72, 74 extend down opposite sides of the work surface 24. The outer faces of the bars 72, 74 include T-slots 76 (only the T-slot for the front bar 72 is shown, but the rear bar 74 may include a similar T-slot). The T-slots 76 are configured to receive attachments, such as nuts. The attachments may be used to hang accessories or other items along the edges of the work surface 24. The T-slots 76 shown in the drawing are located on the outer edges of the bars 72, 74, but similar T-slots may be provided on other locations on the workbench, such as on the top and bottoms of the bars.

A pair of handles 80, 82 are mounted at opposite ends of the work surface 24, and extend between the bars 72, 74. The handles 80, 82 may be formed of wood, steel, plastic, or another suitable material, and may be used to push the workbench 20, or for lifting the ends of the workbench, if necessary.

In accordance with one aspect of the present invention, the work surface 24 includes a cup and tool holder 84, the details of which are shown in FIGS. 5 and 6. A top side of the cup and tool holder 84 includes holes 86 at one end for upright storage of tools, e.g., air tools. An open storage bin 87 for miscellaneous tools and objects is located along the middle of the cup and tool holder 84, and a cup holder 88 is located on the end opposite the holes 86. The bottom of the cup and tool holder 84 includes ribs 89 (FIG. 6) for reinforcement. Ends 85 of the cup and tool holder 84 are flattened, and configured to fit against the bars 72, 74, so that the cup and tool holder is captively fit adjacent the work surface 24. The cup and tool holder 84 may be formed of plastic or any other suitable material.

As can best be seen in FIG. 3, the workbench 20 includes a front panel 90, left and right panels 92, 94, and a rear panel 96. In one embodiment, the front panel 90 is fixed to the frame 28, and the left and right panels 92, 94, and the rear panel 96 are removable. To aid in easy removal, left and right panels 92, 94 include a lower 90-degree lip 98, side edges 100, 102, and a top 90-degree lip 104.

To place the left panel 92 onto the frame 28, the lower 90-degree lip 98 and a top 90-degree lip 104 are aligned slightly over the bottom of the left U-shaped frame end 30 and the side brace 46, respectively, with the side edges 100, 102 aligned just inside the left U-shaped frame end. The left panel 92 is then lowered so that the lower 90-degree lip 98 and a top 90-degree lip 104 rest on the bottom of the left U-shaped frame end 30 and on the side brace 46, respectively. The side edges are sandwiched between, and held steady by, the outer legs of the left U-shaped frame end 30. The right panel 94 may similarly be placed on the opposite side of the frame 28. A handle 104 is provided at the bottom of each of the left and right panels 92, 94 to aid in removal and replacement. One or more screws or other fasteners may be used to lock a panel once it is in position.

The left and right panels 92, 94 include a series of vent holes 106 distributed along their surfaces. The vent holes 106 provide circulation for the compressor 22, and apertures into which hooks for accessories or other items may be hung.

Other structures may be provided for attaching to the ends of the frame 28. For example, one or two tool boxes may be provided that are configured to be attached to the ends of the frame 28.

The left and right panels 92, 94 may be attached in different ways, but preferably at least one of the outer panels of the workbench is easily removable to provide access to the compressor 22. The structure for left and right panels 92, 94 described above is removable without tools, and if a single fastener is used, is quickly removable by releasing the single fastener with a single tool. The rear panel 96 may include similar structure for easy removal, or may include screws or other fasteners that permit removal. By allowing easy removal of the panels 92, 94, and 96, the compressor 22 may be accessed for repair or maintenance.

The panels 90, 92, 94, and 96 form an enclosure around the compressor 22, and help to attenuate the noise made by the air compressor 22. The panels 90, 92, 94, and 96 may be made of any suitable material, such as steel, and may be insulated for sound. In addition, other internal panels may be provided that extend downward from the work surface 24 and surround the prime mover for the compressor 22 for further sound attenuation. If desired, the outer surfaces of the panels 90, 92, 94, and 96 may be painted or otherwise decorated to alter the appearance of the workbench 20.

The air compressor 22 may be a direct drive, belt driven, or may utilize another suitable driving mechanism. Air compressors and their function are well known, and their operation is not discussed in detail here. The air compressor is preferably mounted within the workbench, and, if the panels are used, is surrounded by the panels. In this manner, the compressor 22 is fully supported by the workbench 20, and moves with the workbench when the workbench is rolled around on the wheels 26. In addition, the panels may attenuate some of the sound of the compressor.

A prime mover 108 for the compressor 22 preferably includes an electric motor and a pump, but alternatively may utilize a gasoline engine and a pump. A power cord 109 is provided for connecting the prime mover 108 to a power source. A cord wrap 110 (FIG. 4) may be provided, for example on the back of the rear panel 96, for storage of the power cord 109. If desired, a hose hook (not shown) or the like may be provided for storing one or more air hoses.

Figure 7:
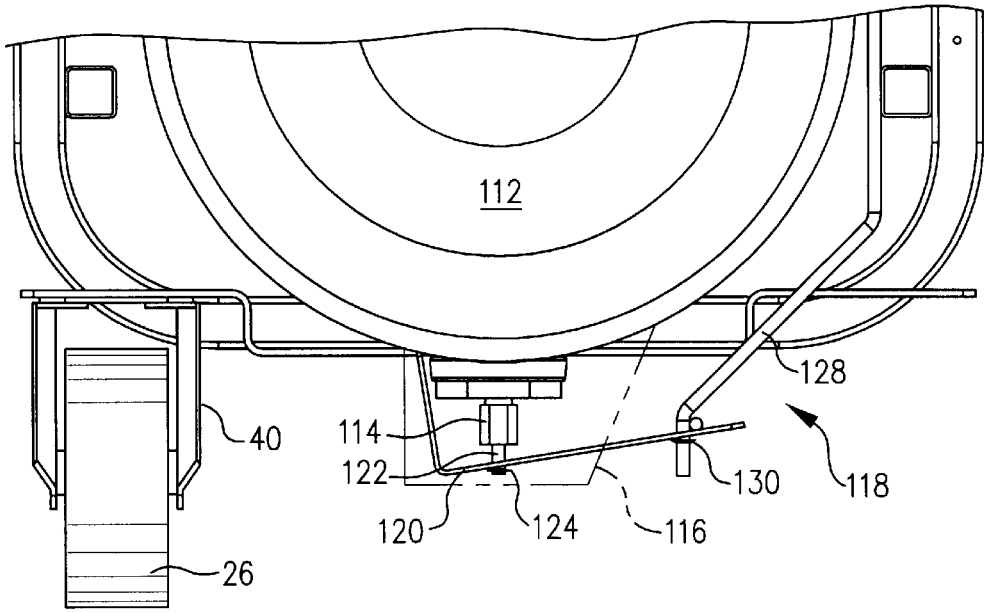
FIG. 7 is a partial-cutaway, side view of the a bottom portion of the compressor workbench of FIG. 1 showing a drain valve actuation mechanism.

The air compressor 22 includes a tank 112, for example a twenty gallon cylindrical tank. The tank 112 includes a drain valve 114 (FIG. 7) on its lower surface for draining water that is generated during compression of air. A metal guard cage 116 (shown in phantom so that other details are visible) extends around the drain valve 114 to prevent the drain valve from being damaged during moving of the workbench 20.

Figure 8:
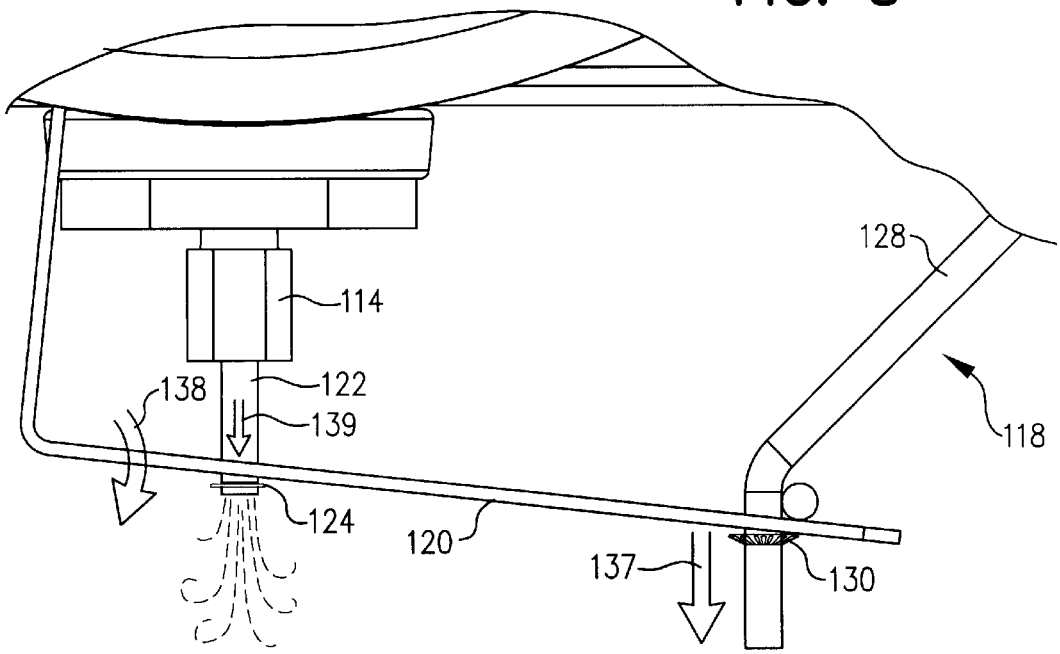
FIG. 8 is a partial-cutaway, side view of the a bottom portion of the compressor workbench of FIG. 1, similar to FIG. 7, with the drain valve actuation mechanism actuated.

The workbench 20 includes a drain valve actuation mechanism 118 that permits the drain valve 114 to be opened without having to reach under the workbench. The drain valve actuation mechanism 118 includes an L-shaped pivot arm 120 that is pivotally attached at one end to a surface on the bottom of the workbench 20, for example to the lower wall of the tank 112. A plunger 122 of the drain valve 114 extends through a hole or slot in the L-shaped pivot arm 120 and includes an "E" retaining ring 124 (best shown in FIG. 8) at its distal end. The "E" retaining ring 124 is sized so that it does not fit through the hole or slot in the L-shaped pivot arm 120. The plunger 122 is spring-biased to a closed position such that the internal pressure of the tank will not open the valve during operation of the compressor 22.

A linkage 128 is connected to the free end of the L-shaped pivot arm 120 by a push retainer 130, which connects up and down movement of the linkage to movement of the L-shaped pivot arm 120. The opposite end of the linkage includes a 90-degree bend 131 that extends through a C-slot 132 in the front panel 90. A knob 134 is attached to the distal end of the linkage 128.

Figure 9:
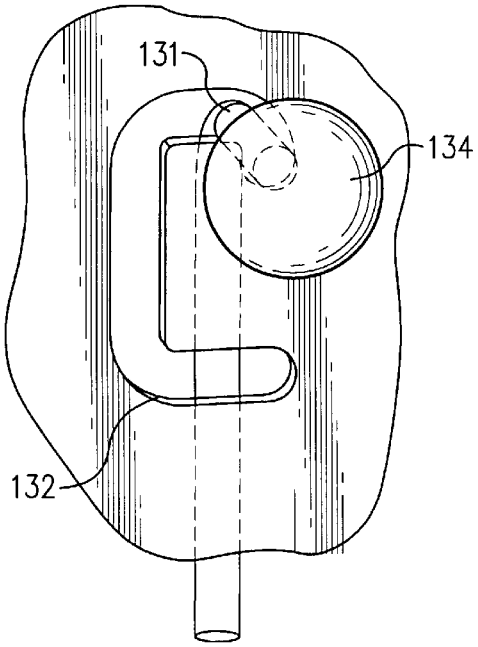
FIG. 9 is a cutaway detail view of the handle for the drain valve actuation mechanism, shown in a normal, closed position.
Figure 10:
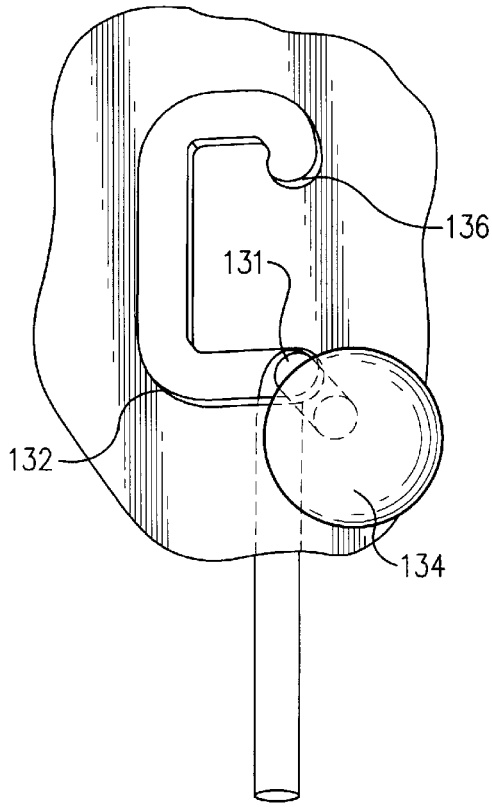
FIG. 10 is a cutaway detail view of the handle of FIG. 9, shown in an opened position.

During operation of the compressor 22, the knob 134 is typically maintained in an upper position, such as is shown in FIG. 9. In the upper position, the linkage 128 is prevented from moving downward by the 90-degree bend 131 of the linkage being caught in a downwardly-sloping portion 136 (shown best in FIG. 10) at the upper end of the C-slot 132. In this position, the drain valve 114 is closed.

To operate the drain valve actuation mechanism 118 to open the drain valve 112, the knob 134 is grasped by a user, and rotated around the C-slot to the lower position shown in FIG. 9. This movement causes the linkage to move down, shown by the arrow 137 in FIG. 8, which in turn causes the L-shaped pivot arm 120 to pivot downward (arrow 138), pulling the plunger 122 downward (arrow 139), and opening the drain valve 112.

Using the drain valve actuation mechanism 118 permits a user to drain water from the tank 112 without having to reach under the workbench 20. Other mechanisms may be used to actuate the drain valve remotely. For example, a drain valve actuation mechanism may be foot operated, may use one or more solenoids connected to a switch, or may have other means for remotely opening a drain valve that is connected to the air compressor tank.

In accordance with another aspect of the present invention, a control panel 140 (FIG. 1) is mounted on the front side of the workbench 20 on the outside of the enclosure formed by the panels 90, 92, 94, and 96. The control panel 140 includes a quick disconnect 142 to which an air hose may be attached, a safety relief valve 144 for the tank 112, and a regulator knob 146 for setting the outlet flow of an air hose attached to the quick disconnect 142. A pressure gauge 148 for the tank is supplied, as well as a pressure gauge 150 for the hose connected to the quick disconnect 142. An on/off switch 162 is provided on the front of the control panel 140. The function and operation of each of these items is known in the art of air compressors, and thus will not be discussed in detail here. Other controls and gauges may be provided. For example, a second quick disconnect, regulator, and gauge may be provided for a compressor that can handle multiple outputs.

The workbench 20 of the present invention may be sized as convenient, but preferably is of sufficient size so that the compressor can be fully enclosed by the panels 90, 92, 94, and 96. In one embodiment of the present invention, the workbench 20 is 39 inches high, 36 inches wide, and 19 inches deep. This size allows the workbench 20 to be reasonably stored, and provides a work surface 24 that is sized so that it may be used for several different home improvement projects.

Figure 11:
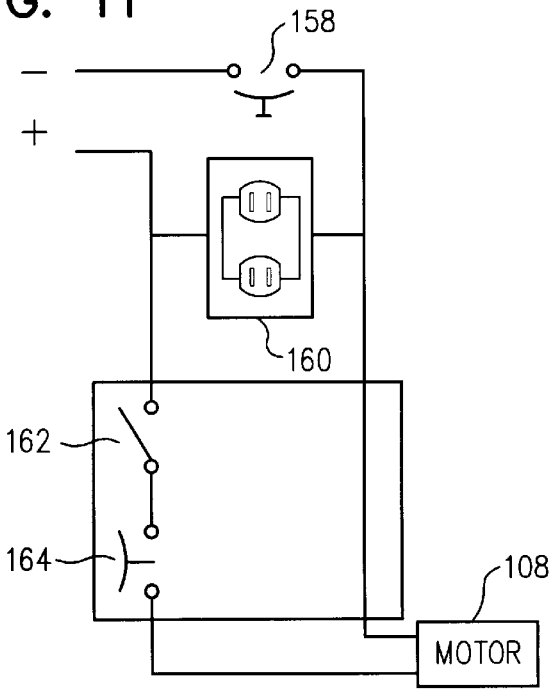
FIG. 11 is a simple schematic for a compressor and outlet combination that may be used with the workbench of FIG. 1.

In accordance with one aspect of the present invention, the workbench may include a power supply, such as an outlet 160 (FIG. 1). A simplified circuit for the outlet 160 is shown in FIG. 11. The outlet 160 is connected to a power supply, with a circuit breaker 158 (e.g., a 15 amp circuit breaker) between the power supply and the outlet.

The prime mover 108 is wired in series with the outlet 150, and power to the prime mover is determined by the switch 162 and the pressure switch 164. The pressure switch 164 is connected to the tank 112, and is in a normally opened position, and closes when the tank exceeds a lower pressure threshold. The pressure switch remains closed as long as the pressure is above the lower pressure threshold, and the tank does not exceed an upper pressure threshold. In general, for the prime mover 108 to operate, the switch 162 must be turned to an "on" position, and the pressure switch must be in the closed position. When the pressure in the tank 112 exceeds the upper threshold, the pressure switch 164 is opened, and the power to the prime mover is cut.

Figure 12:
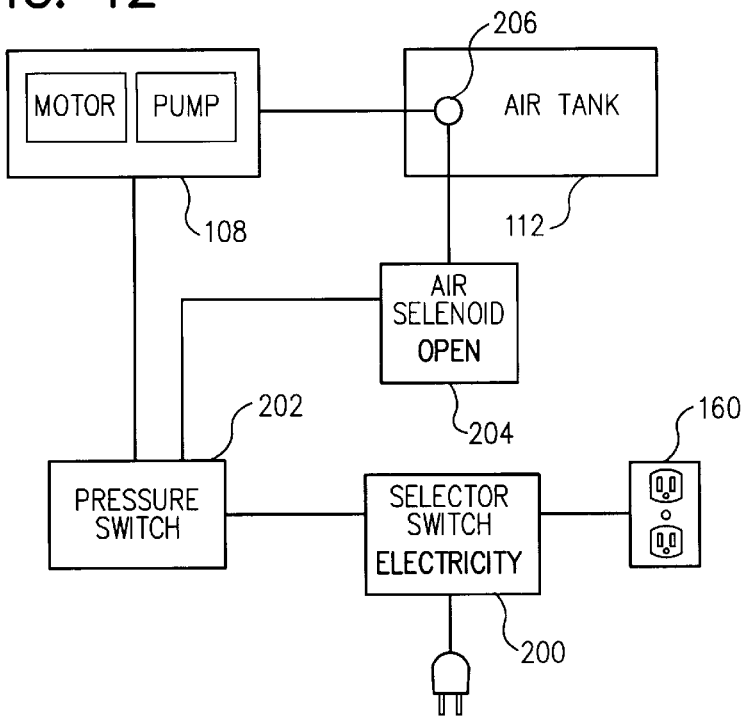
FIG. 12 is a simple schematic for an alternate embodiment of a compressor and outlet combination that may be used with the workbench of FIG. 1, with a switch turned to an "outlet on" position.
Figure 13:
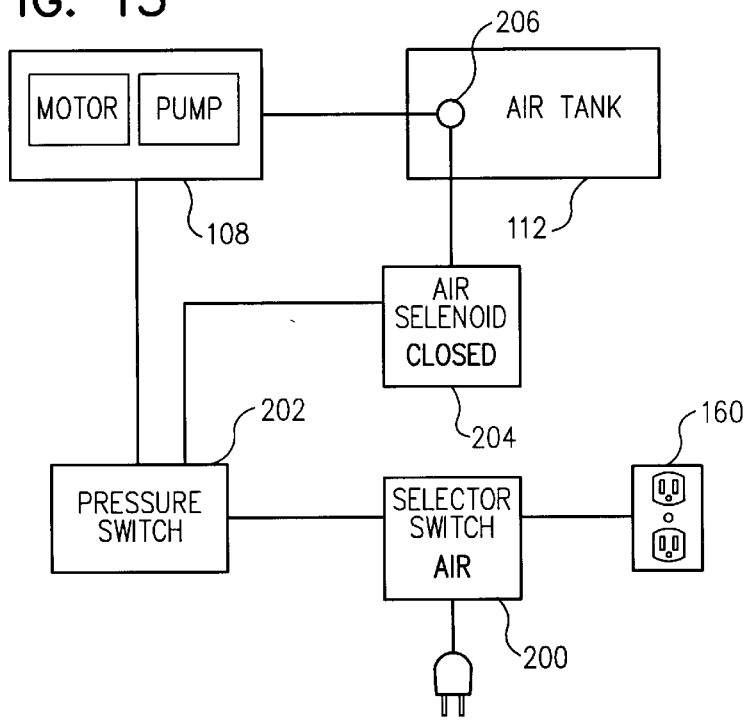
FIG. 13 is the simple schematic of FIG. 12, with the switch turned to a "compressor pump on" position.

In the system shown in FIG. 11, the outlet 160 has power whether the prime mover 108 is operating or not. If desired, the power circuit for the outlet 160 and the prime mover 108 may include a switching system that permits a user to remove power from the prime mover 108, so that all power is directed to the outlet 160. Such a system is shown in FIGS. 12 and 13. In the system of these figures, a switch 200, for example, a heavy duty switch or relay mounted on the front panel, may be set at "ELECTRICITY" or "AIR." When the switch is set to the "ELECTRICITY" position, power is cut to the pump motor (prime mover) 108, and all current is directed towards the outlet 160 at the rated amperage of the circuit (e.g., 15 amps). When the switch 200 is set to "AIR," the power is cut to the outlet 160, and the routed to the pump motor (prime mover) 108. The pump motor 108 then activates as needed to maintain pressure in the tank 112 in a manner known in the art.

As is known, when a pump for a compressor is running, air is pressurized in the pump head, and as it reaches an appropriate pressure, enters the compressor tank through a one-way check valve. In normal air compressors, a pressure switch 202 bleeds the air trapped between the pump and the check valve when there is a signal from the tank (e.g., upper pressure limit) to deactivate the motor. The pressurized air is thus removed from the pump head, so that the pump is ready for use again when the pressure in the tank falls below the minimum threshold.

When the pump is turned off by the switch 200, however, there may be pressurized air trapped in the pump's head. A user may, for example, switch power away from the pump during an activated cycle, and switch back later. If the pressure is too great within the pump's head, the motor may not be able to start operation of the pump against the pressure.

To alleviate this problem, in accordance with one aspect of the present invention, an air solenoid 204 is provided in the circuit with the switch 200 and the pressure switch 202. The air solenoid 204 is connected to the check valve 206 for the air tank 112, and is in a normally open position (FIG. 12), wherein pressure for the pump head is allowed to vent (via the check valve through the opened air solenoid 204). The air solenoid 204, wired with the pressure switch 202, will close when the switch 200 is placed in the "AIR" position, allowing the pressure switch to bleed as needed (i.e., such as in normal air compressor operation). The air solenoid 204 is in the normal, opened position when the switch 200 is in the "ELECTRICAL" position. Thus, when the electrical outlet 160 is activated, the pressure in the pump head is released, allowing the pressure switch 200 to bleed the pump head pressure through a the air solenoid 204.

Other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

What is claimed is:

1. An apparatus comprising:

a frame;

an air compressor mounted in the frame, the air compressor comprising an air tank;

an enclosure surrounding the air tank;

a drain valve on the tank;

a manual drain actuation mechanism mounted outside of the enclosure; and a linkage connecting the drain actuation mechanism to the drain valve, wherein manual actuation of the drain actuation mechanism causes the drain valve to open, permitting the tank to drain.

2. The apparatus of claim 1, further comprising wheels on the apparatus, the wheels being positioned so that the apparatus can be rolled.

3. The apparatus of claim 1, wherein the enclosure comprises multiple panels, and wherein at least one of the panels fits into a slot on the frame, wherein the panel may be easily removed or replaced.

4. The apparatus of claim 1, wherein the enclosure comprises multiple panels, and wherein at least one of the panels is removable with the removal of a single fastener.

5. The apparatus of claim 1, wherein the enclosure comprises multiple panels, and wherein at least one of the panels is removable.

6. The apparatus of claim 1, wherein the drain actuation mechanism comprises a handle.

7. The apparatus of claim 1, further comprising:

a power cord connected to the motor by an electric circuit; and an electrical outlet wired to the circuit in series with the motor.

8. The apparatus of claim 7, further comprising a switch for selectively switching power supplied via the power cord between the motor and the outlet.

9. The apparatus of claim 8, further comprising a bleed valve for bleeding the pressure within the pump when the switch switches power to the outlet, and a mechanism, connected to the circuit, that opens the bleed valve when the switch switches power to the outlet.

10. The apparatus of claim 9, wherein the mechanism is a solenoid.

11. The apparatus of claim 7, wherein the outlet is mounted on the enclosure.

12. The apparatus of claim 7, further comprising sound-detonating panels mounted around the motor.

13. The apparatus of claim 1, further comprising sound-detonating panels mounted around the motor.

14. The apparatus of claim 1, wherein the enclosure comprises front, rear, left and right side panels, and wherein the side panels are removable.

15. An Apparatus comprising:

an electric motor connected to a compressor a power cord connected to the electric motor by an electric circuit;

an electrical outlet wired to the circuit in series with the motor; and a switch for selectively switching power supplied via the power cord between the motor and the outlet, the switch being operable between a first position where power is directed to the outlet and is cut from the electrical motor, and a second position where power is directed to the electrical motor and cut from the outlet.

16. The apparatus of claim 15, wherein the compressor is an air compressor comprising a pump, and further comprising a bleed valve for bleeding the pressure within the pump when the switch switches power to the outlet, and a mechanism, connected to the circuit, that opens the bleed valve when the switch switches power to the outlet.

17. The apparatus of claim 16, wherein the mechanism is a solenoid.

* * * * *